US005400623A

United States Patent [19]

Bota

[11] Patent Number: 5,400,623

[45] Date of Patent: Mar. 28, 1995

[54] LEG/ANKLE ARRESTOR

[76] Inventor: Julius Bota, 11774 Newell Rd., Dunkirk, N.Y. 14048

[21] Appl. No.: 280,180

[22] Filed: Jul. 25, 1994

[51] Int. Cl.[6] ..... E05B 75/00

[52] U.S. Cl. ..... 70/16; 128/869; 273/84 R

[58] Field of Search ..... 70/14–19, 70/30, 49, 50, 57, 209; 24/116 A, 16 PB; 273/84 R; 119/856, 857, 863, 770; 128/869, 870, 876, 882; 297/464, 466

[56] References Cited

U.S. PATENT DOCUMENTS

| | | | |
|---|---|---|---|
| Re. 14,714 | 8/1919 | Pratt | 70/17 X |
| 380,441 | 4/1888 | Hyatt et al. | 70/16 |
| 832,143 | 10/1906 | Mercer | 70/17 |
| 1,803,280 | 4/1931 | Stull et al. | 70/16 |
| 2,215,454 | 9/1940 | Condit | 128/870 |
| 2,790,418 | 4/1957 | Boling | 119/863 X |
| 3,621,681 | 11/1971 | Mikesic | 70/16 |
| 3,933,154 | 1/1976 | Cabansag | 128/870 |
| 4,103,524 | 8/1978 | Mitchell et al. | 70/209 |
| 4,426,079 | 1/1984 | Mason | 273/84 R |
| 4,860,560 | 8/1989 | Lundeuus | 70/16 |
| 4,970,884 | 11/1990 | Solow | 70/209 |
| 5,031,639 | 7/1991 | Wolfer | 128/869 X |
| 5,066,013 | 11/1991 | Kubota | 273/84 R |
| 5,067,445 | 11/1991 | Matthews | 119/152 |
| 5,085,433 | 2/1992 | Parsons | 273/84 R |
| 5,138,852 | 8/1992 | Corcoran | 70/16 |
| 5,159,728 | 11/1992 | Bingold | 24/16 PB |
| 5,190,055 | 3/1993 | O'Connor | 128/869 |
| 5,261,728 | 11/1993 | Carmichael | 297/482 |
| 5,345,947 | 9/1994 | Fisher | 70/16 X |

*Primary Examiner*—Peter M. Cuomo
*Assistant Examiner*—Suzanne L. Dino
*Attorney, Agent, or Firm*—Shlesinger Fitzsimmons Shlesinger

[57] ABSTRACT

An elongate, rigid restraint member is disposed to be positioned by an arresting officer vertically behind a suspect's back. One ankle of the suspect is then releasably secured by a clamping mechanism to the lower end of the member, and a strap at the upper end of the member is secured snugly by the officer around the suspect's neck, thereby forming a substantially rigid restraint between the suspect's ankle and neck.

10 Claims, 2 Drawing Sheets

LEG/ANKLE ARRESTOR

BACKGROUND OF THE INVENTION

This invention relates to a novel arrestor device for use by police officers and the like for restraining the movements of a suspect who has been placed under arrest. Even more particularly this invention relates to an elongate, generally rigid device which is adapted to be positioned vertically behind the back of the suspect under arrest, and to be attached at its lower end to the suspect's ankle, and at its upper end by a strap to the suspect's neck.

One of the most difficult problems for an officer involved in the arrest of a particularly violent person is to restrain the suspect before injury occurs to either the officer or the person cuffs can be utilized for restraining a criminal suspect or the being arrested. While in most cases a conventional pair of hand like, nevertheless in many cases it is necessary to restrain the person in such manner that he or she is rendered incapable of running away, or from utilizing his or her arms in some manner which would lead to serious injury of the parties involved in the arrest.

It is an object of this invention, therefore, to provide a novel arrestor or restraining device which is designed, in practice, to connect at least one ankle of a suspect that is being arrested to his or her neck by virtue of an elongate, rigid restraint, which is arranged to extend upwardly behind a person's back, and between his or her restrained ankle and neck.

Still another object of the invention is to provide a novel, generally rigid restraining device of the type described which can be readily operated by an arresting officer simply by placing the device behind the suspect's back, and then securing a clamping mechanism at one end of the device securely around one ankle of the suspect, and securing a strap at the opposite end of the device around the suspect's neck and in such manner so as to be inaccessable to the restrained suspect.

Other objects of the invention will be apparent hereinafter from the specification and from the recital of the appended claims, particularly when read in conjunction with the accompanying drawings.

SUMMARY OF THE INVENTION

The arrestor device is in the form of an elongate bar or rod somewhat in the shape of a shepherd's staff in that it has a generally U-shaped hook or clamping section formed on one end thereof, and has a handle section formed on its opposite end. Slidably mounted on the rod is an elongate slide or clamping member having integral with and projecting laterally from one end thereof a curved clamping section which is complimentary to the clamping section on the bar, and which is disposed to be shifted by the clamping member from a retracted to an advanced or clamping position in which it releasably secures the ankle of a suspect coaxially between its curved surface and the confronting, hook shaped end of the bar or rod upon which the clamping member slides. Projecting laterally from the opposite end of the clamping member is a housing containing a spring-loaded latch or detent, which, when the clamping element of the slide member is in its operative, clamping position, is disposed to be seated releasably in one of a series of notches formed in the confronting side of the rod upon which the slide or clamping member reciprocates.

After a suspect's ankle has been clamped to one end of the rod, the rod is disposed to be positioned vertically behind the suspect's back, and in such a manner that a strap which is secured at one end to one side of a handle section of the rod, can be wrapped around the suspect's neck, and then can be secured releasably adjacent its opposite end in the opposite end of the handle section of the rod, thus forming a generally rigid connection between a person's clamped ankle and his or her neck. The slide member which carries the complimentary clamping element, can be fastened at any one of any several different positions thereby to accommodate ankles of different sizes in the clamping section of the device.

THE DRAWINGS

Figure 2:
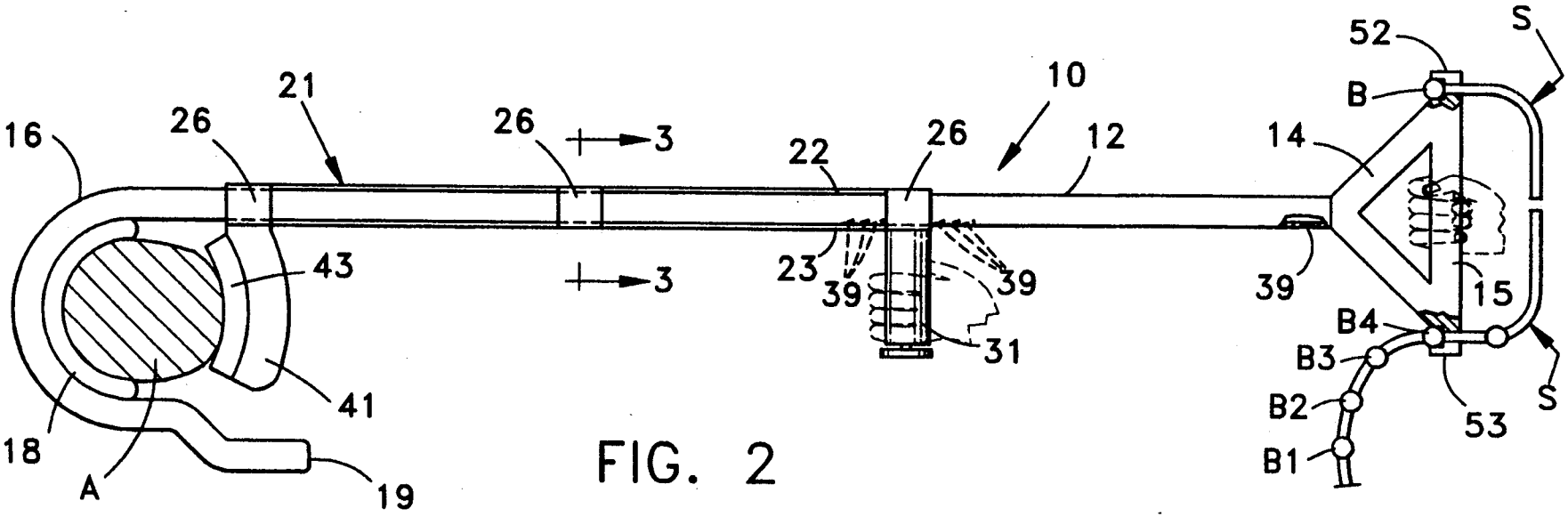
FIG. 2 is a side elevational view of this device as seen after the slide member has been advanced into a clamping position relative to the ankle of a person, and with the operator's hands again being shown fragmentarily for purposes of illustration.
Figure 4:
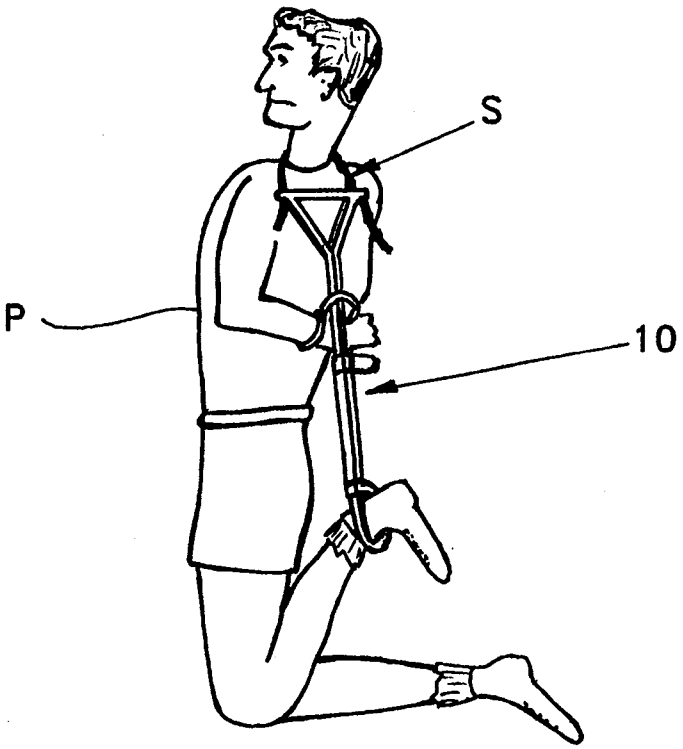
Figure 3:
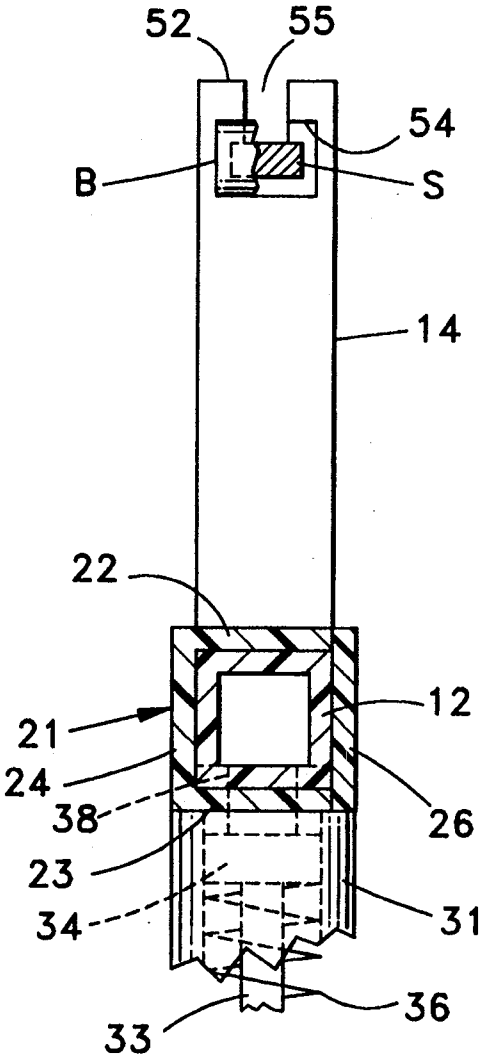

FIG. 3 is a greatly enlarged fragmentary sectional view taken generally along the line 3—3 in FIG. 2 looking in the direction of the arrows; and FIG. 4 is a schematic perspective view illustrating the arrestor device as it appears when applied to a kneeling suspect in such manner that the device is attached at one end to the ankle of the suspect, and at its opposite ends to the neck of the suspect whose hands in the embodiment illustrated are shown to be connected by handcuffs rearwardly of the device.

DETAILED DESCRIPTION OF THE PREFERRED EMBODIMENT

Referring now to the drawings by numerals of reference, and first to FIGS. 1 to 3, 10 denotes generally a restraint or arrestor device comprising an elongate, tubular rod or bar 12, which is rectangular in cross section, and which has formed on one end thereof a generally triangularly shaped handle 14, including a hand grip section 15 that extends transversely of the axis of bar 12. Bar 12 has formed on its opposite end a curved or hook-shaped clamping section 16 having a curved or arcuate clamping surface 17, which faces rearwardly toward the handle 14 of the rod, and which is covered by a resilient pad 18. The terminal end of the clamping section 16 is slightly offset as at 19 from the clamping surface 17 of section 16.

Mounted for longitudinal sliding movement on the rod 12 is a slide or clamping member that is denoted generally by the numeral 21. In the embodiment illustrated, and as shown more clearly in FIG. 3, member 21 is rectangular in cross section, and comprises a pair of spaced, parallel top and bottom wall sections 22 and 23, respectively, which overlie, and slide upon the upper and lower surfaces, respectively, of rod 12. Wall sections 22 and 23 are integral with and project at right angles from a side wall section 24 of member 21, which overlies and has sliding engagement with one side (the far side in FIGS. 1 and 2) of the rectangularly shaped rod 12. The reason for this construction is that during the manufacture of the device 10, the slide member 21, comprising the intersecting wall sections 22–24, can be inserted over one side of the rectangular rod 12, and then can be secured for sliding movement on the rod by a plurality (three in the embodiment illustrated) of longitudinally spaced brackets or clips 26, which slidably overlie the side of the rod 12 shown in FIGS. 1 and 2, and which are fastened at opposite ends thereof in any conventional manner to the confronting edges of the slide member walls 22 and 23, respectively. Alternatively, of course, instead of utilizing the clips 26, the slide member 21 could comprise a tubular member having therethrough an axial bore, which is rectangular in cross section, and the walls of which would have sliding engagement with the outer surfaces of the rectangularly shaped rod 12.

Figure 1:
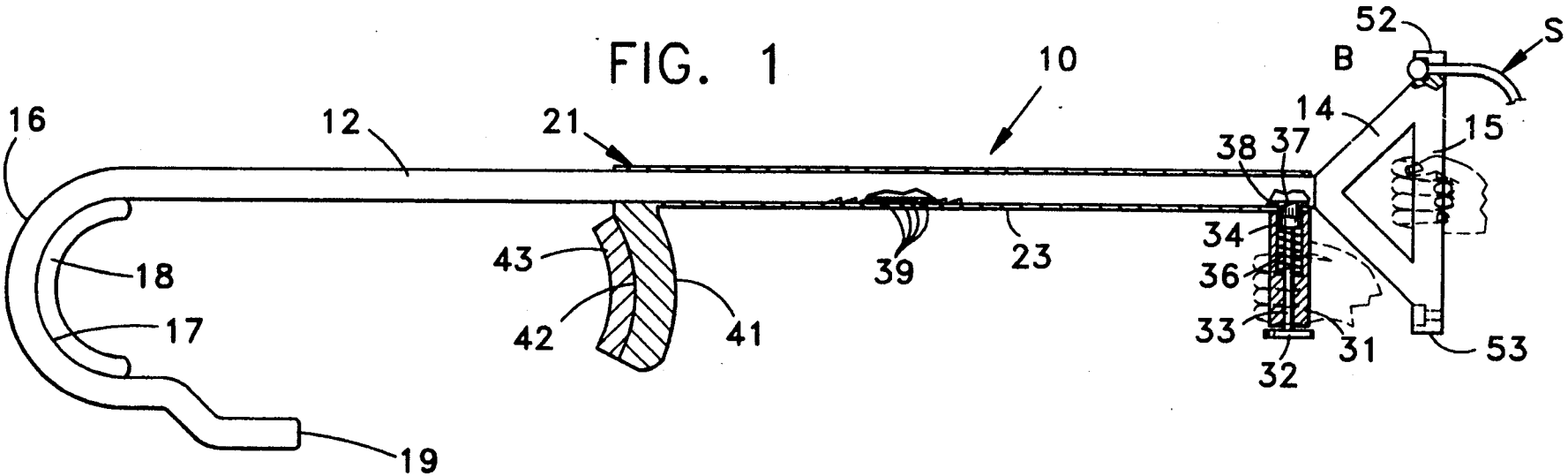
FIG. 1 is a side elevational view of an elongate restraint or arresting device made according to one embodiment of this invention, the slide member of the device beng shown in section in its retracted position, and with the hands of an operator being shown fragmentarily for purposes of illustration.

Secured to and projecting from the underside of slide member 21 at the end thereof adjacent the handle 14 is a cylindrical latch housing 31. Removably seated against and overlying the lower end of housing 31 is a disc-shaped actuator plate 32. Secured at its lower end centrally to the upper surface of plate 32, and mounted for limited reciprocation in an axial bore formed in the lower end of housing 31 is a spring-loaded detent pin 33. Adjacent its upper end pin 33 has formed thereon a rectangularly shaped collar 34, which is slidable in a rectangularly shaped counterbore 35 that is formed in the upper end of housing 31. A coiled compression spring 36, which surrounds pin 33 between its collar 34 and the bottom of the counterbore 35, urges pin 33 upwardly in housing 31, so that when the slide member 21 is in its retracted or inactive position as shown in FIG. 1, an inclined tooth section 37, which is formed in the upper end of pin 33, is urged into a latching position in which plate 32 is seated resiliently against the underside of housing 31, and the tooth section 37 extends upwardly through a registering opening 38 in the bottom wall 23 of member 21, and releasably into a registering notch 39 (FIG. 2) formed in the underside of rod 12 adjacent its handle 14. As noted in greater detail hereinafter, in this position the slide or clamping member 21 is releasably retained in its retracted position.

At the end thereof remote from the detent housing 31, the slidable clamping member 21 has projecting from one side thereof, the underside of its lower wall 23 in the embodiment illustrated, an integral, curved clamping section 41, which has formed on the side thereof remote from housing 31 a curved clamping section 42 which is covered by a resilient, arcuate pad 43. The curved section 41 and its pad 43 face in the direction of and are complimentary to the curved pad 18 carried by the hook-shaped end 16 of the rod 12.

When it is desired to clamp the ankle of a suspect in a device 10, the handle 14 of rod 12 is gripped in one hand and the detent housing 31 is gripped in the other hand of the arresting officer, who then urges the clamping member 21 longitudinally of the rod 12 from its retracted position as shown in FIG. 1, to an advanced or clamping position as shown in FIG. 2, wherein the ankle A of the suspect is clamped firmly between the confronting, arcuate pads 18 and 43 on the clamp sections 16 and 41, respectively. During this movement of member 21 the inclined surface on the upper end of the latching tooth 37 causes the latching pin 33 to be urged slightly downwardly against the resistance of spring 36, as the upper end of the tooth 37 slides along the bottom of rod 12. As the slide member 21 approaches its clamping position, the upper end 37 of the latching pin 33 continues to ratchet past a number of additional notches 39 formed in the underside of rod 12 intermediate its ends, until such time that the ankle A of a person becomes securely clamped between the clamping section 16 and 41, at which time the upper end 37 of the latching pin 33 will come to rest in one of the additional notches 39 that are located intermediate the ends of rod 12. In this position the upper end of pin 33 will prevent slide member 21 from shifting rearwardly on rod 12 until such time that the plate 32 is grasped manually and pulled downwardly against the resistance of spring 36, which will thereby cause the upper end 37 of the pin to be removed from a registering notch 39, and thus enable the slide member 21 to be retracted to release the ankle A of a person.

Hand grip section 15 of rod 12 has projecting from opposite ends thereof integral, strap supporting lug sections 52 and 53, respectively. At one side thereof (the left side as shown in FIG. 1), each projection 52 and 53 has therein an arcuate recess 54 (see FIG. 3) which registers with the inner end of a generally T-shaped slot 55 that is formed in the outer end of each projection 52 amd 53. One end of a strap S, which is seated in the inner end of the slot 55 in projection 52, has integral therewith an enlarged-diameter bead section B, which is seated in the arcuate recess 54 in projection 52. Strap S extends from its bead B through the projection 52, and is adapted to be releasably attached at its opposite end in the correspondingly T-shaped slot formed in the projection 53 at the opposite end of the hand grip section 15. As shown more clearly in FIG. 2, the end of strap S remote from its bead B has formed thereon a plurality of longitudinally spaced, integral bead sections B1, B2, B3, etc., any one of which is adapted to be seated in the arcuate recess 54 which is formed in projection 53 in a manner similar to that of recess 54 in projection 52.

To insert the strap S into the slot 55 in projection 52, the strap is turned to insert its narrow portion through the outer, narrow end of slot 55, and then the strap is rotated into the position as shown in FIG. 3, wherein it completely fills the inner, wider end of the slot 55. The bead B is then free to seat in the arcuate recess 54 to prevent the strap S from being pulled out of the slot 55, or toward the right from the position as shown in FIG. 1. In a similar manner, the opposite end of strap S is adapted to have any portion thereof between a pair of the bead sections B1, B2, etc. inserted into the T-shaped slot in projection 53 in a manner similar to that described above in connection with the projection 52.

Referring now to FIG. 4, wherein the letter P denotes the person under arrest, the person is incapacitated by locating the device 10 behind the person, and then clamping his or her ankle between the clamping sections 16 and 41 by advancing the sliding clamping member 21 forwardly from its retracted to its advanced position as shown in FIG. 2, at which time the clamping member 21 will be secured releasably in its clamping position by virtue of the insertion of the upper end 37 of the latching pin 33 into one of the notches 39 located intermediate the ends of rod 12. The strap S is then wrapped around the person's neck, and the end of the strap containing the spaced beads B1, B2, etc. is releasably secured in the T-shaped slot in the projection 53, thereby restraining the person P in the manner shown for example in FIG. 4. At that time the person's hands can then be handcuffed behind him or her, and around opposite sides of the device 10.

From the foregoing it will be apparent that the present invention provides a relatively simple and inexpensive means for rapidly and safely restraining a person that has been, or is being placed under arrest, or the like. The resilient pads 43 and 18 on the clamping sections prevent any unnecessary injury to the ankle of the person that is restrained, while the adjustable strap S permits the person's neck to be attached to the upper end of the device 10 without unduly choking or throttling the arrestee. Both the generally staff-shaped rod section 12, and the slidable clamping section 21 can be made out of a light, rigid plastic material, thus simplifying the difficulty in manipulating the device. With proper training, the operator can manipulate device 10 rapidly and with minimum effort, and once thus restrained the suspect can be easily handcuffed as desired.

While the present invention has been illustrated and described in detail in connection with only certain embodiments thereof, it will be apparent that it is capable of still further modification without departing from this invention. For example, the manner in which the strap S is releasably attached to the projection 53 can be readily altered, for example, by utilizing a simple belt-type hasp fastening mechanism, while the spring-loaded latch pin 33 obviously could, if desired, constitute a simple pin which is removably placed in and removed from registering openings in the rod 12 and the clamping member 21 that is slidable thereon. It should be noted also that while the device 10 is readily applied to a suspect, it need not necessarily be maintained in its clamping position once the suspect has been handcuffed. That, of course, will depend upon the temperament of the suspect.

It is to be understood also that the overall length of the restraint 10 can be designed for a person of average height, in which case, if the person happens to be taller than average, this variation can be accommodated by the adjustable strap S. Also, of course, the device 10 could be made in different lengths, and if desired, the section 12 could include a provision for adjusting its length.

Also, while the slightly offset portion 19 of the clamping section 16 has been shown to be of a length of which it extends beyond the clamping section 41, when the latter is in its operative position as shown in FIG. 2, it will be apparent that the overall length of this offset section 19 is a matter of choice, and could be made shorter (or longer), if desired. Moreover, the offset section 19 could be made as a separate section removably attached to the curved clamping section 16 of rod 12, and as such could be made in different sizes, and could be slipped or clipped onto section 16 as needed. It is used primarily to guide a person's leg or ankle A into position against the pad 18 on clamping section 16. Moreover, it is intended that this application cover any such modifications that may fall within the scope of one skilled in the art, or the appended claims.

I claim:

1. A device for restraining certain movements of an arrested suspect, comprising an elongate, rigid restraint member disposed to be positioned vertically behind the back of a suspect, and having adjacent one end thereof a generally hook-shaped clamping surface disposed to encircle part of one ankle of the suspect, a clamping member mounted on said restraint member for movement-between retracted and advanced positions, respectively, with respect to said hook-shaped clamping surface on said restraint member, said clamping member having thereon a curved clamping surface complementary to said hook-shaped clamping surface, and disposed substantially to encircle the remaining portion of said one ankle of the suspect, when said clamping member has been moved to said advanced position thereof, and means on the opposite end of said restraint member For encircling and releasably securing the neck of said suspect to said opposite end of said restraint member.

2. A device as defined in claim 1, wherein said means on said opposite end of said restraint member comprises, a strap secured at one end to one side of said restraint member and disposed to pass at its opposite end around the neck of said suspect, and means on the opposite side of said restraint member for releasably and adjustably securing said opposite end of said strap to said opposite side of said restraint member, thereby snugly to retain said strap around the suspect's neck.

3. A device as defined in claim 1, wherein each of said clamping surfaces has a resilient pad secured thereon for engagement with said one ankle of said suspect.

4. A device as defined in claim 1, wherein said clamping member is mounted for longitudinal sliding movement on said restraint member between said advanced and retracted positions thereof, said curved clamping surface projects laterally from one side of said clamping member adjacent one end thereof, and latching means is interposed between said restraint member and said clamping member and is operative automatically to secure said clamping member releasably in its advanced position upon movement thereof from its retracted to its advanced position.

5. A device as defined in claim 4, wherein said latching means comprises a spring-loaded detent carried by one of said members and having a pointed latching surface on one end thereof disposed to have sliding engagement with a confronting surface on the other of said members when said clamping member is moved toward its advanced position, said confronting surface on said other member having therein a plurality of longitudinally spaced notches each of which is disposed selectively to accommodate said pointed latching surface of said detent releasably to secure said clamping member selectively in one of several different advanced positions with respect to said hook-shaped clamping surface.

6. A device as defined in claim 5, wherein said confronting surface on said other member has therein one additional notch longitudinally spaced from said plurality of notches, and disposed releasably to accommodate said pointed latching surface of said detent when said clamping member is in its retracted position.

7. A device as defined in claim 1, wherein said restraint member has formed on said opposite end thereof a handle including a hand grip section extending transversely of the length of said restraint member, and said means for encircling and releasably securing the neck of said suspect comprises an elongate, flexible element secured at one end to one end of said hand grip section of said handle, and disposed to be releasably and adjustably secured adjacent its opposite end to the opposite end of said hand grip section.

8. A device as defined in claim 1, wherein said retraint member is generally rectangular in cross section intermediate its ends, and said clamping member is mounted for longitudinal sliding movement on said restraint member and has therein for at least a portion of its length a rectangularly shaped bore having sliding engagement with the outer surface of said restraint member.

9. An arrestor device for restraining certain movements of a person, comprising an elongate, rigid restraint member disposed to be positioned vertically behind a person's back, a handle formed on one end of said member, and a hook formed on the opposite end thereof and disposed to encircle part of a person's ankle, a clamping member mounted for longitudinal sliding movement on said restraint member between said hook and said handle, a curved clamping surface projecting laterally from one end of said clamping member in spaced, confronting registry with said hook on said restraint member, a hand grip projecting laterally from the opposite end of said clamping member for use in reciprocating said clamping member manually on said restraint member between retracted and advanced positions, respectively, with respect to said hook, means on said hand grip for releasably securing said clamping member in an advanced position in which said clamping surface thereon is disposed to enclose and clamp the remaining portion of a person's ankle in said hook, and a strap connected at one end to one side of said handle on said restraint member, and disposed intermediate its ends to encircle the neck of said person, and to be releasably and adjustably secured at its opposite end to the opposite side of said handle.

10. An arrestor device as defined in claim 9, including a resilient pad secured to each of the confronting surfaces of said hook and said clamping surface, respectively.

* * * * *